US010626607B2

(12) United States Patent
Ganzha

(10) Patent No.: US 10,626,607 B2
(45) Date of Patent: Apr. 21, 2020

(54) MULTILAYER STRUCTURAL MODULE FOR CONSTRUCTION

(71) Applicant: Vitalii V. Ganzha, Kyivska oblast (UA)

(72) Inventor: Vitalii V. Ganzha, Kyivska oblast (UA)

( * ) Notice: Subject to any disclaimer, the term of this patent is extended or adjusted under 35 U.S.C. 154(b) by 0 days.

(21) Appl. No.: 16/217,283

(22) Filed: Dec. 12, 2018

(65) Prior Publication Data

US 2020/0080309 A1 Mar. 12, 2020

(30) Foreign Application Priority Data

Sep. 6, 2018 (UA) ..... A201809160

(51) Int. Cl.

| | |
|---|---|
| ***E04C 2/06*** | (2006.01) |
| ***E04B 2/94*** | (2006.01) |
| ***E04C 2/04*** | (2006.01) |
| ***E04C 2/288*** | (2006.01) |

(52) U.S. Cl.

CPC ..... *E04C 2/06* (2013.01); *E04B 2/94* (2013.01); *E04C 2/049* (2013.01); *E04C 2/288* (2013.01); *E04B 2103/02* (2013.01); *E04B 2103/06* (2013.01)

(58) Field of Classification Search

CPC ... E04C 2/049; E04C 2/88; E04C 2/06; E04C 2/04; E04B 2/94; E04B 2103/02; E04B 2103/06

See application file for complete search history.

(56) References Cited

U.S. PATENT DOCUMENTS 3,775,916 A * 12/1973 Bair ..... E04B 2/60 52/125.4
4,702,058 A * 10/1987 Bennett ..... E04C 2/288 52/309.11
4,751,803 A 6/1988 Zimmerman
(Continued)

FOREIGN PATENT DOCUMENTS

DE 19542315 A1 4/2004
EP 2140992 B1 * 12/2012
(Continued)

*Primary Examiner* — Beth A Stephan
(74) *Attorney, Agent, or Firm* — Kohn & Associates, PLLC

(57) ABSTRACT

A building module comprising a bearing wall element having the form of a rectangular parallelepiped with openings intended for installation of window and/or door units and/or hinged elements, heat-insulating, reinforcing and finishing layers, having the same surface area, successively attached onto a bearing wall reinforced concrete element, the said surface area indents from an edge of the bearing wall element along the perimeter, the bearing wall element is made of lightweight reinforced concrete comprising a concrete mixture with lightweight fillers and a spatial frame formed by plane reinforced frames interconnected in a horizontal plane and embedded connectors and transport loops located on an outer edge, with extra reinforcing elements having a form of parallel rods positioned in an upper part of the spatial frame are located between plane frames, and the spatial frame is filled with concrete and is made using lightweight filler.

6 Claims, 2 Drawing Sheets

(56) References Cited

U.S. PATENT DOCUMENTS

| | | | | |
|---|---|---|---|---|
| 5,697,189 | A * | 12/1997 | Miller | E04C 2/2885 52/309.12 |
| 2004/0206032 | A1* | 10/2004 | Messenger | E02D 27/02 52/506.01 |
| 2011/0252728 | A1* | 10/2011 | Scherrer | E04B 1/7675 52/220.1 |
| 2014/0260030 | A1* | 9/2014 | Propst | B32B 3/06 52/309.12 |

FOREIGN PATENT DOCUMENTS

| | | | |
|---|---|---|---|
| EP | 2418058 | A2 * | 2/2015 |
| EP | 3059058 | A2 * | 8/2016 |
| EP | 3059354 | A1 * | 8/2016 |
| EP | 3059354 | B1 | 4/2018 |
| FR | 2709504 | A1 * | 7/1993 |
| FR | 2709504 | A1 | 3/1995 |

* cited by examiner

MULTILAYER STRUCTURAL MODULE FOR CONSTRUCTION

BACKGROUND OF THE INVENTION

1. Technical Field

The invention relates to the construction industry, more particularly to building structures, which are completely factory-assembled modular elements having the form of wall structures that have a rigid bearing base, an insulating and finishing layers attached thereto and may be used in the construction of civilian and industrial facilities with high requirements for strength, heat insulation, waterproofing and decorative external facing of buildings having any number of floors.

2. Background Art

The unit-based construction often uses concrete poured frame structures, which form a wall surface, with insulating and finishing layers attached thereto after erection of a building. Such configuration is not efficient, so once such structures have been mounted, a building needs additional insulation, both external and internal, as well as finishing making the construction an intensive process, both in terms of time and costs, especially when it comes to construction of high-rise buildings.

Solutions intended to provide more efficient construction methods by making ready-made building modules with insulating and finishing layers attached thereto are known in the prior art.

The prior art discloses structural modules, which are fully factory-assembled wall structures having surface protective and finishing layers and are used as ready-made units for erection of buildings varying in the number of floors and intended for housing or public needs. The advantage of factory-assembled building structures is that the number of operations required to erect a finished building at a construction site is minimized, so the construction time can be significantly reduced. Today, however, the development of better building systems for construction of inexpensive, efficient and easy-to-build housing units has slowed down due to requirements for quick, high-quality and inexpensive construction of residential units having an elastic design that does not require significant efforts for maintenance and, at the same time, is firmly structured and provides the required insulation.

The U.S. Pat. No. 4,751,803 dd. Jun. 21, 1998 is known to the applicant and discloses a building module which is made of steel frame structures with protruding horizontal and vertical beams connected by their ends to form fasteners at edges for subsequent assembly, the said structures are coated with an insulating layer reinforced with a wire mesh and poured with a concrete mixture to form a bearing base together with the insulating layer and the reinforcing layer with a finishing layer, preferably made of bricks, attached to the outside of the said layers to form a ready-made module that can be transported to a construction site for erection of a building.

The disadvantage of this structure is that the concrete poured steel frame structure restricts the availability of the invention, since heavyweight reinforced concrete frames—besides difficulties with transporting and mounting associated with a high probability of mechanical damage to the finishing layer and chipping of the frame itself—have low resistance to static loads limiting their application to preferably low-rise buildings. Further, when mounting such building modules it is necessary to provide additional insulation of joints between adjacent modules. Another disadvantage is that due to the box-shaped structure formed by the framed design, the said modules form the so-called "cold bridges" causing heat losses.

The drawback associated with heavyweight is partially solved by Patent DE 19542315 dd. Apr. 24, 1997 disclosing a structural module with a lightweight reinforced concrete base and a layer which is attached thereto and also has a concrete matrix consisting of water, cement, foaming agent, and plasticizer and contains, as a filler, pumice particles or foam glass pellets or foam plastic granules that provide extra heat-insulating and waterproofing properties.

The problem with walls of this type is that the more lightweight the concrete, the less mechanical strength the walls exhibit, and, as a consequence, the said walls do not meet the minimum static requirements for high-rise buildings. Further, the said structure does not allow a manufacturer to prefabricate a heat-insulating layer and a finishing layer.

Patent Application FR 2709504 A1 dd. Mar. 10, 1995 discloses a building module having a bearing reinforced concrete wall element with a heat-insulating layer attached to the outside of the said wall element, and the said layer is made of a concrete mixture with vegetable fibers, and a finishing layer made of a plaster material is attached to the said layer.

The said building module makes it possible to simplify erection of residential and public buildings thanks to a lightweight heat-insulating layer and a finishing layer prefabricated on the bearing reinforced concrete element; however the disadvantage of the solution known in the prior art is insufficient shear resistance of the finishing layer and high thermal conductivity of the module due to the materials used to form the said layers as well as relatively insufficient hydrophobicity of both the module itself and buildings erected with such modules due to insufficient waterproofing of joints between both the modules and their structural elements, i.e. between a heat-insulating layer and a finishing layer and window and/or door units or hinged elements, such as balconies or the like.

Based on the set of features for solving the problems known in the prior art, Patent EP 3059354 B1 dd. Apr. 18, 2018 is considered as the closest prior art. The said patent discloses a building module comprising a bearing, preferably reinforced concrete, wall element having the form of a rectangular parallelepiped, with openings therein designed to install window and/or door units, a heat-insulating layer, a reinforcing layer and a finishing layer configured so that the said layers indent from the edge of the bearing wall element, and the reinforcing layer has a bond strength of at least 0.8 MPa when it bonds to the finishing layer. The building module configured to have a bearing element, a heat-insulating layer, a reinforcing layer and a finishing layer makes it possible to simplify erection of residential and public buildings and, as a consequence, to reduce their production costs as well as to increase their heat-insulating properties by creating the required heat-insulating layer and finishing layer, which performs protective and decorative functions, concurrently with the mounting of modules. However, as noted above, the bulkiness and heavy weight of the base is a significant drawback for construction projects using ready-made building modules.

To meet strength and stability standards, such panels are made of heavyweight concrete. A considerable weight of such structural elements of buildings increases installation and transportation costs and, under certain circumstances, the costs required to strengthen the foundation of a building. Under increased external loads, especially those of dynamic nature, the use of heavyweight concrete panels does not provide the required level of strength and stability of buildings.

SUMMARY OF THE INVENTION

The present invention provides for a building module including a bearing wall element having the form of a rectangular parallelepiped with openings intended for installation of window and/or door units and/or hinged elements, heat-insulating, reinforcing and finishing layers, having the same surface area, successively attached onto a bearing wall reinforced concrete element, the surface area indents from an edge of the bearing wall element along the perimeter, with the reinforcing layer having a bond strength to the base element of at least 0.8 MPa, wherein thickness of the heat-insulating layer is selected so that the building module has resistance to heat transfer in the range of Rq=2.91-10.80 m2 K/W, the bearing wall element is made of lightweight reinforced concrete comprising a concrete mixture with lightweight fillers and a spatial frame formed by plane reinforced frames interconnected in a horizontal plane and embedded connectors and transport loops located on an outer edge, with extra reinforcing elements having a form of parallel rods positioned in an upper part of the spatial frame are located between plane frames, and the spatial frame is filled with concrete having a density of 1,600-1,800 kg/m3 and a specific strength of 20-45 MPa and is made using lightweight filler.

DESCRIPTION OF THE DRAWINGS

The present invention is illustrated by the following exemplary embodiment of the building module and the method for mounting such building modules and accompanying drawings, wherein.

DETAILED DESCRIPTION OF THE INVENTION

Figure 1:
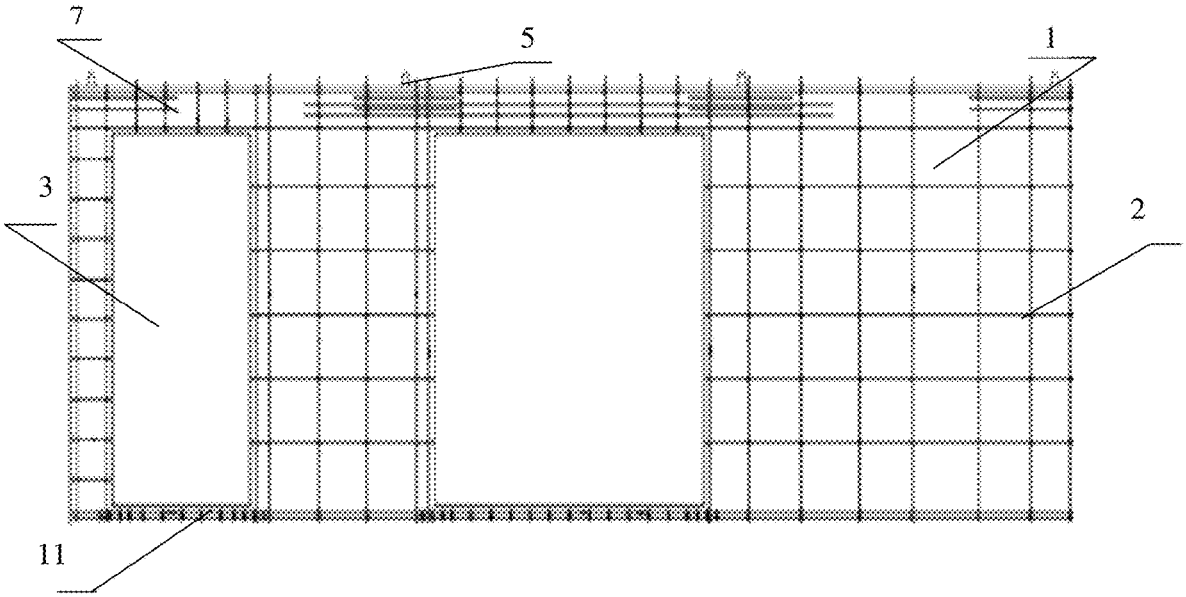
FIG. 1 is a front view of the spatial reinforcing frame of the building module.
Figure 2:
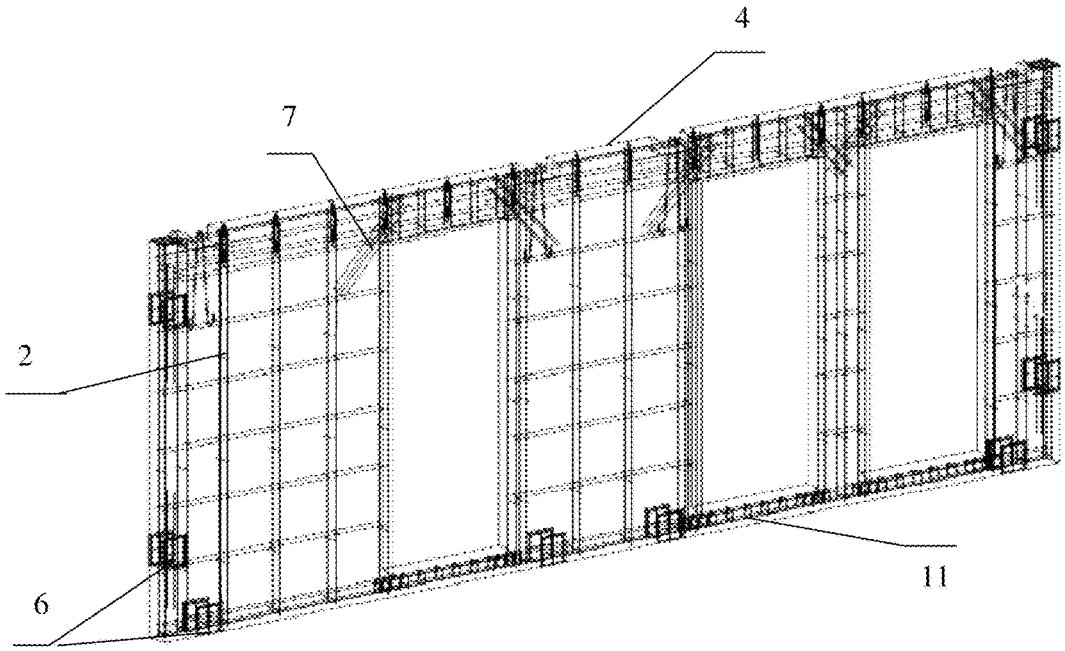
FIG. 2 is an axonometric view of the ready-made bearing wall element.
Figure 3:
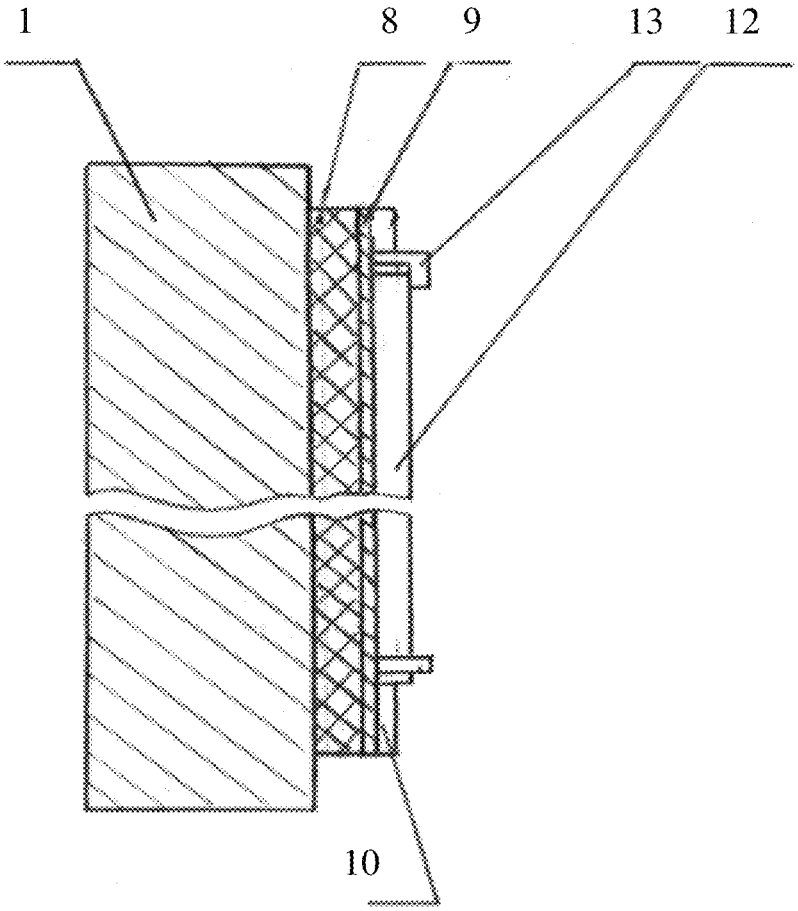
FIG. 3 is a side view of the building module with a finishing layer.

Given the above considerations, the object of the invention is to improve the building module to take into account and address, as far as practically possible, the disadvantages of the prior art to meet the requirements for lightweight, strength and resistance to static and dynamic loads and atmospheric exposure, so that the building module, which has high heat-insulating and waterproofing qualities, comprises a lightweight reinforced concrete element and features high strength and resistance to static and dynamic loads. Further, there is a need to increase resistance to thermal conductivity in accordance with the operational requirements in a wide range of climatic zones which today tends to increase as energy costs grow.

Figurative materials that illustrate the invention claimed as well as the exemplary embodiment of the building module are in no way intended to limit the claims appended hereto but to explain the essence of the invention.

A bearing wall element (1) of a building module is formed by plane reinforcing frames (2), interconnected in their horizontal plane, made from a set of vertical and horizontal elongated steel rods connected at points of intersection by cross-welding so that they form openings (3) for the installation of window and/or door units which make a spatial frame having the form of a rectangular parallelepiped (4) with embedded transport loops (5) and fasteners (6) located between plane reinforcing frames (2) along the outer edge of the spatial frame (4).

Extra reinforcing elements (7) are positioned between plane frames (2) in the upper parts, at an angle to the openings so formed (3). The bearing wall element (1) poured with a concrete mixture has a heat-insulating layer (8), a reinforcing layer (9) and a finishing layer (10) attached thereto so that they indent along the perimeter of the bearing wall element (1) and the height of which is equal to the height of working protrusions of fastening (6) elements embedded in the thickness of the bearing wall element (1), and the formed grooves, from which outer parts of embedded transport (5) loops protrude, and at sites of openings (3) for installation of window and/or door units, its lower part has connecting rods (11) positioned between plane frames, and the respective units (12) may be inserted in the openings (3) and the protruding decorative elements (13) may be fastened therein.

The said object is achieved by a building module comprising a bearing wall element (1) having the form of a rectangular parallelepiped with openings (3) intended for installation of window and/or door units, the heat-insulating (8), reinforcing (9) and finishing layers (10), having the same surface area, successively attached onto the bearing wall element (1), the said surface area sets back from the edge of the bearing wall element (1) along the perimeter, with the reinforcing layer (9) having a bond strength to the base element of at least 0.8 MPa. According to the invention, thickness of the heat-insulating layer (8) is selected so that the building module has resistance to heat transfer in the range of Rq=2.91 . . . 10.80 $m^2$ K/W, the bearing wall element (1) is made of lightweight reinforced concrete comprising a concrete mixture with lightweight fillers and a spatial frame (4) formed by plane reinforced frames (2) interconnected in the horizontal plane and embedded fasteners (6) and transport loops (5) located on the outer edge. There are extra reinforcing elements (7) positioned between plane frames in the upper part of the spatial frame (4). The spatial reinforcement frame (4) is filled with concrete having a density of 1,600-1,800 kg/$m^3$ and a specific strength of 20-45 MPa and is made using lightweight filler.

The embodiment of the building module having a bearing element (1), a heat-insulating layer (8), a reinforcing layer (9) and a finishing layer (10) allows to simplify erection of residential and public buildings and to improve their heat-insulating properties by creating the required heat-insulating layer (8) and finishing layer (10), which provides protective and decorative functions, concurrently with the mounting of modules.

The embodiment of a heat-insulating layer (8), a reinforcing layer (9), and a finishing layer (10) so that the said layers indent from the edge of the bearing wall element (1) along its perimeter allows for the capture of the module by special means of transport and the subsequent mounting of edge parts of the module without damaging the said layers, and allows to form a surface whereon means for sealing and heat insulation of joints between adjacent modules may be subsequently fixed during their mounting, such as, for example, heat- and water-insulating linings.

The said thermal conductivity parameters are optimal so that the building module provides resistance to heat transfer in accordance with the building design requirements and, at the same time, does not require attachment of an extra heat-insulating layer at a construction stage to the finishing layer of the module. By designing the module in accordance with the applicable rules and regulations and by making the spatial frame in accordance with the project design and by complying with the technological regulations, applicable standards and rules, it is possible to create a solid and, at the same time, elastic structure that can safely maintain the pre-set linear dimensions of the module when the said element is poured with lightweight concrete and when an external heat-insulating layer (8) and a finishing layer (10) are fastened.

The experiments showed that a combination of a spatial frame (4) and lightweight concrete with a density of 1,600-1,800 kg/m$^3$ and a specific strength of 25-45 MPa in a reinforced concrete wall element allows, without any additional loads, to mount all of the said external layers thereon, and the said wall element retains resistance to static and dynamic loads during operation of the module as a whole and, at the same time, resistance to heat transfer is kept within Rq=2.91. . . 10.80 m$^2$ K/W as required for the operation of buildings in a wide range of climatic conditions.

To develop a composition of concrete, extensive tests were carried out using different grades of lightweight air-hardened concrete and porous fillers, forms of reinforcing frames (2), thicknesses and materials of a heat-insulating layer (8) and a finishing layer (10) to find out the optimal, according to the inventor, ratio of the said parameters which is represented as a set of features in the claims section.

Of the samples so tested, concrete classes LC20/22, LC25/28, LC30/33, LC35/38 and density class LC1.8 with a specific compressive strength of 25-45 MPa were selected by adding porous filler of an average fraction, and the operational reliability of the said samples was associated with technological properties preserved by such concrete for a long time and a fairly high coefficient of adhesion with reinforcement elements which may be embedded inside such concrete.

Thickness of layers attached to the bearing wall element (1) varied depending on how they achieve optimal thermal conductivity under a specific bond strength and under conditions of combination with the optimal lightweight concrete used to form the bearing wall element (1), with due consideration of tis thermal conductivity.

The results of these tests are presented in the table below.

| Concrete density, kg/m$^3$ | Heat-heat-insulating layer thickness, mm | Heat transfer resistance, m$^2$K/W |
|---|---|---|
| 1,900 | 100 | 2.85 |
| | 160 | 4.29 |
| | 200 | 5.25 |
| | 300 | 7.61 |
| | 400 | 9.92 |
| 1,800 | 100 | 2.91 |
| | 160 | 4.37 |
| | 200 | 5.34 |
| | 300 | 7.78 |
| | 400 | 10 |
| 1,700 | 100 | 2.95 |
| | 160 | 4.41 |
| | 200 | 5.45 |
| | 300 | 7.85 |
| | 400 | 10.3 |
| | 100 | 3.01 |
| | 160 | 4.55 |
| | 200 | 5.62 |
| | 300 | 7.96 |
| | 400 | 10.8 |

It was found that an increase in thickness of a heat-insulating layer combined with lightweight structural concrete with a density of more than 1,800 kg/m$^3$ does not solve the said problem but leads to a decrease in resistance to thermal conductivity. At the same time, moderate thickness of a heat-insulating layer in the range of 100 . . . 400 mm combined with the bearing wall base with a reinforcing spatial frame poured with concrete having a density of 1,600 . . . 1,800 kg/m$^3$, allows to achieve thermal conductivity parameters considered optimal in terms of thermal conductivity of a building module and energy efficiency standards for buildings in different climatic zones.

Porous fillers are known to reduce the weight and density of concrete and improve its thermal properties, so structural concrete with expanded clay filling is selected, firstly, because natural components are used as starting materials making it environmentally friendly and, secondly, lightweight concrete with expanded clay filling is known to be of high strength while its bulk density remains low making it suitable for use in buildings requiring a more lightweight bearing structure.

Thus, it was determined that a combination of the spatial frame (4) and lightweight concrete having a density of 1,600-1,800 kg/m$^3$ and a specific strength of 25-45 MPa in a bearing wall element (1) allows to obtain a product that would satisfy the requirements for concrete and reinforced concrete products, standard requirements for actual strength, density and thermal conductivity applicable in specific climatic and seismic zones.

The placement of extra reinforcing elements (7) located in the upper part of the spatial frame (4) between plane frames (2) helps to distribute to the load more evenly throughout the entire reinforced concrete base without overloading the structure of the spatial frame (4).

Extra reinforcing elements (7) made in top corners of the openings (3) which they form to mount window and/or door units and/or hinged elements at an angle of 90° to the diagonal of the openings (3) with the central part facing the parts of plane frames (2), allow to distribute specific loads and to significantly reduce the concentration of loads arising in the corners of the openings (3).

As shown by the experiments, the use of extra reinforcing elements (7), having a simple design and located at the top of the panel, is the most efficient solution both to achieve the required strength and to minimize cost of reinforcing materials.

According to another embodiment of this invention, expanded clay with a fraction of 5-10 mm is used as porous filler in lightweight concrete to significantly reduce the weight of the building module, maintain the required density and strength, meet the required standards and provide additional heat-insulating and waterproofing properties.

According to yet another embodiment of this invention, in order to strengthen the spatial frame (4), its lower part has connecting rods between plane frames (2) at sites where openings (3) for installation of window and/or door units are positioned.

To make the building module as ready-to-use as possible and to simplify erection of building structures with the use of such modules, the said building module comprises window units and/or door units and/or hinged elements installed in respective openings (3).

Further, a finishing layer (10) comprises decorative elements (13) attached to the surface of the finishing layer (10) at sites where window units and/or door units and/or hinged (balcony) elements are positioned. The use of decorative elements (13) attached sites where window units and/or door units and/or hinged elements are positioned allows to provide extra waterproofing and heat insulation of joints between the finishing layer (10) and heat-insulating layer (8) of the module and window units and/or door units and/or hinged elements to improve the above parameters of the building as a whole.

The combination of all the features of this invention allows to reduce the weight of the module and achieve the optimal strength and stability of structures made of such modules, while thermal conductivity is kept at minimum and the bearing wall element (1), heat-insulating (8) and finishing layers (10) remain stable and, as a consequence, to use such modules to erect structures exposed to increased external loads such as winds or seismic loads.

To better understand the invention and its advantages, the following description is intended to explain the exemplary embodiment thereof.

The building module can be made by forming a bearing element (1) first by making and placing a spatial reinforcing frame (4) in a form together with embedded transport loops (5) and fasteners (6), intended to mount the modules, followed by pouring concrete to obtain a monolithic bearing element (1) after concrete hardening.

To manufacture a spatial reinforcement frame (4), metal profiles made of reinforcing steel with a diameter of 8-10 mm and rolled steel may be used to make embedded elements which are widely manufactured by different enterprises and used in the construction sector. Dimensions of the spatial frame (4) having the form of a rectangular parallelepiped with pre-set openings (3) intended for the installation of window or door units are determined by the width of the wall to be built, while its height is determined by the climatic characteristics of the area where the wall is to be built.

Further, in the spatial frame (4), extra stiffeners are welded in top corners of the openings (3) so formed for the installation of window and/or door units, while the lower parts of the openings (3) are tightened with reinforcing rings. All the elements of the spatial frame (4) are interconnected by contact flash welding and/or by resistance-spot welding at points between elements of plane frames (2) and plane frames (2), and by arc welding at points where plane frames (2) are coupled to form the spatial one (4).

A distance between vertical and horizontal elements of plane frames (2) is determined in accordance with architectural requirements and calculations made to design separate elements of buildings in accordance with the requirements for modular coordination of construction dimensions applicable to the respective climatic and seismic zones.

Before pouring concrete, paired embedded fasteners (6) are positioned on the sides of the frame (2), along its outer edge. The reinforcing frame (2) is then filled with concrete to form a frame-free site along the edge of the bearing wall element (1) to provide further protection of reinforcing protrusions, embedded fasteners (6) and transport elements (5) from corrosion and to prevent any protuberances, chips and shells which may be formed on sites used to connect to other modules—so the panel mounting process will be significantly simplified.

The bearing element (1) so formed is then cleaned and primed, and window and/or door units are then mounted. The heat-insulating (8) and reinforcing layers (9) are then formed on the bearing element (1) by adding an adhesive mixture and a fiber grid to expanded polystyrene to reinforce the structure with a fiberglass grid. Further, the finishing layer (10) is then formed, e.g., using clinker tiles to be glued to the heat-insulating layer (8).

The heat-insulating layer (8), the reinforcing layer (9) and the finishing layer (10) are made so that the said layers indent from the edge of the bearing wall element (10. The width of such indention from the edge of the bearing wall element (1) and the edge of the heat-insulating (8), reinforcing (9), and finishing layers (10) is within the range of 10 . . . 250 mm, e.g. 15 mm. The thickness of the heat-insulating layer (8) may vary in the range of 100 . . . 400 mm, e.g. 100 mm. The reinforcing layer (9) has a bond strength of at least 0.8 MPa when it bonds to the finishing layer (10). The thickness of the finishing layer (10) is within 10 . . . 100 mm, for example, 50 mm. The thickness of the heat-insulating layer (8) is so that the building module has resistance to heat transfer in the range of Rq=2.91 . . . 10.80 $m^2$ K/W.

The thickness of the heat-insulating layer (8) provides the value of the heat transfer resistance of the building module within Rq=2.91 . . . 10.80 m2 K/W.

The finishing layer (10) may be made using clinker tiles attached to its external surface. The external surface of the finishing layer (10) of the module may be equipped with both clinker facing tiles and natural stone, decorative mixtures etc. The building module comprises window units and door units mounted and protruding decorative elements (13) fixed thereon. Decorative elements (13) are fixed at sites where window units and door units are positioned along their perimeter. Decorative elements (13) are made, for example, of reinforced expanded polystyrene and fastened to the bearing wall element using an adhesive mixture. The internal surface of the bearing element (not shown) may be decorated with a primer and have openings, made to locate electric elements, and inner slopes along the perimeter of windows or doors etc.

The method of mounting building modules of the said structure is implemented as follows:

First, bearing wall elements (1) having heat-insulating (8), reinforcing (9), and finishing layers (10) are mounted, fixed and fastened to each other with coupling elements, such as paired embedded elements located on side surfaces of the module and coupled to each other by welding. Coupling elements are then coated with a protective coating to prevent corrosion processes. Joints between bearing elements (1) of adjacent building modules are then sealed by insulating joints, inserting special linings and applying a special sealing compound or a self-adhesive tape. The gap between heat-insulating layers (8) of adjacent modules is then filled with a heat-insulating material. Filling with the heat-insulating material may be carried out by placing an expanded polystyrene insertion into the gap. The insertion is made so that its geometric dimensions in section (length and width) correspond to those of the gap, and its length corresponds to a height of the building module. Further, additional sealing of joints between side surfaces of insertion and the respective side surfaces of heat-insulating layers (8) may be carried out by the method disclosed above followed by fastening insulating linings onto the surface of modules by gluing them to the surface of the heat-insulating layer (8) of each adjacent building modules and by mechanical fastening to the bearing wall element (1) of the module (to reinforced concrete element). Protruding architectural decorative elements, such as horizontal or vertical structures made of reinforced expanded polystyrene, may be used as insulating linings. The width of insulating linings must be at least 5% bigger than the width of the gap between heat-insulating layers (8) of adjacent modules. To glue decorative insulating linings, a multifunctional cement-based adhesive mixture and the like products may be used. For both protruding decorative elements and insulating linings, polystyrene may be reinforced with a fiberglass grid when respective elements are manufactured. For horizontal insulating linings, additional protection with a cornice placed on top along the linings may be used when building modules are mounted. Decorative elements (13) and insulating linings may have a coating layer of a facade textured putty and paint.

Thus, the technical solution disclosed above provides the more lightweight building module comprising the bearing element (1), a heat-insulating layer (8), a reinforced layer (9) and a finishing layer (10) and having improved heat-insulating and strength parameters and is easier-to-mount during the construction with building modules of the structure described above.

What is claimed is:

1. A building module comprising a bearing wall element having a form of a rectangular parallelepiped with openings intended for installation of window and/or door units and/or hinged elements, heat-insulating, reinforcing and finishing layers, having a same surface area, successively attached onto the bearing wall element, the said surface area indents from the edge of the bearing wall element along a perimeter, with the reinforcing layer having a bond strength to the finishing layer of at least 0.8 MPa, wherein a thickness of the heat-insulating layer is selected so that the building module has resistance to heat transfer in the range of Rq=2.91 . . . 10.80 $m^2K/W$, the bearing wall element is made of lightweight reinforced concrete comprising a concrete mixture with lightweight fillers and a spatial reinforced frame having a form of a rectangular parallelepiped and formed by two plane reinforced frames interconnected in the horizontal plane and embedded connectors and transport loops located on the outer edge, with reinforcing elements having a form of parallel rods positioned in the upper part of the spatial reinforced frame are located between plane reinforced frames, and the spatial reinforced frame is filled with concrete having a density of 1,600-1,800 $kg/m^3$ and a specific strength of 20-45 MPa and is made using lightweight filler.

2. The building module of claim 1 wherein expanded clay with a fraction of 5-10 mm is used as lightweight filler.

3. The building module of claim 1 wherein the reinforcing elements are attached in top angles of the openings intended for installation of window and/or door units and/or hinged elements at an angle of 90° to diagonals thereof.

4. The building module of claims 1 wherein the lower part of the spatial frame has extra strengthening of a reinforcing structure at sites of openings for window and/or door units and/or hinged elements.

5. The building module of claim 1 wherein window and/or door units and/or hinged elements are installed in respective openings.

6. The building module of claim 1 wherein decorative elements are attached to the finishing layer.

* * * * *